US010780702B2

(12) United States Patent
Nakamura et al.

(10) Patent No.: US 10,780,702 B2
(45) Date of Patent: Sep. 22, 2020

(54) LIQUID EJECTING HEAD UNIT, LIQUID EJECTING APPARATUS, AND MAINTENANCE METHOD FOR LIQUID EJECTING APPARATUS

(71) Applicant: SEIKO EPSON CORPORATION, Tokyo (JP)

(72) Inventors: Chikashi Nakamura, Azumino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/418,425

(22) Filed: May 21, 2019

(65) Prior Publication Data

US 2019/0270311 A1 Sep. 5, 2019

Related U.S. Application Data

(62) Division of application No. 15/905,900, filed on Feb. 27, 2018, now Pat. No. 10,399,342.

(30) Foreign Application Priority Data

Feb. 27, 2017 (JP) ..... 2017-034465

(51) Int. Cl.
*B41J 2/17* (2006.01)
*B41J 29/17* (2006.01)
(Continued)

(52) U.S. Cl.
CPC ..... *B41J 2/1707* (2013.01); *B41J 2/16508* (2013.01); *B41J 2/16511* (2013.01);
(Continued)

(58) Field of Classification Search
CPC ..... B41J 2/1707; B41J 2/18; B41J 2/16523; B41J 2/16505; B41J 2/165; B41P 2235/21
See application file for complete search history.

(56) References Cited

U.S. PATENT DOCUMENTS 8,657,407 B2 2/2014 Kyotani
2005/0168517 A1 8/2005 Usuda
(Continued)

FOREIGN PATENT DOCUMENTS

JP 2001-018408 A 1/2001
JP 2003-334962 A 11/2003
(Continued)

OTHER PUBLICATIONS

Brian S. Hilton. Thermal InkJet Maintenance Cap with Piezoelectric Element for Humidification, Jun. 30, 1997, Xerox Disclosure Journal—vol. 22, No. 3, pp. 149-150 May/Jun. 1997 see also IP.com prior art database technical disclosure, Pub. date Apr. 8, 2004. IPCOM00002751D (Year: 1997).

*Primary Examiner* — Sharon A. Polk
(74) *Attorney, Agent, or Firm* — Workman Nydegger

(57) ABSTRACT

A liquid ejecting head unit includes a liquid ejecting head having a nozzle forming portion in which a nozzle that ejects a liquid to a medium is formed, a shutter that has an opening portion exposing the nozzle and that is movable between a cover position in which a recessed portion including the nozzle is covered and an exposure position in which the nozzle is exposed, and a first communication portion that communicates with an inside of the recessed portion and that is capable of supplying a fluid into the recessed portion.

4 Claims, 4 Drawing Sheets

(51) Int. Cl.

| | |
|---|---|
| ***B41J 2/165*** | (2006.01) |
| ***B41J 2/175*** | (2006.01) |
| ***B41J 2/18*** | (2006.01) |

(52) U.S. Cl.

CPC ..... *B41J 2/16523* (2013.01); *B41J 2/16526* (2013.01); *B41J 2/16585* (2013.01); *B41J 2/175* (2013.01); *B41J 2/18* (2013.01); *B41J 29/17* (2013.01); *B41J 2002/16502* (2013.01); *B41P 2235/21* (2013.01)

(56) References Cited

U.S. PATENT DOCUMENTS

| | | | | |
|---|---|---|---|---|
| 2006/0103690 | A1* | 5/2006 | Katayama ..... | B41J 2/16508 347/29 |
| 2009/0109257 | A1 | 4/2009 | Shimazaki | |
| 2012/0249628 | A1 | 10/2012 | Katsuki | |
| 2013/0241992 | A1 | 9/2013 | Shimizu et al. | |
| 2016/0009094 | A1* | 1/2016 | Kawakami ..... | B41J 2/16552 347/25 |

FOREIGN PATENT DOCUMENTS

| | | | |
|---|---|---|---|
| JP | 2010-000709 | A | 1/2010 |
| JP | 5041106 | B | 7/2012 |
| JP | 2012-171320 | A | 9/2012 |
| JP | 2012-206516 | A | 10/2012 |
| JP | 2013-176935 | A | 9/2013 |
| JP | 2013-216095 | A | 10/2013 |

* cited by examiner

LIQUID EJECTING HEAD UNIT, LIQUID EJECTING APPARATUS, AND MAINTENANCE METHOD FOR LIQUID EJECTING APPARATUS

CROSS-REFERENCE TO RELATED APPLICATIONS

This application is a divisional application of U.S. patent application Ser. No. 15/905,900, filed Feb. 27, 2018, which claims priority to Japanese Patent Application No. 2017-034465, filed Feb. 27, 2017, the entire disclosures of which are expressly incorporated by reference herein.

BACKGROUND

1. Technical Field

The invention relates to a liquid ejecting apparatus such as an ink jet printer, a liquid ejecting head unit provided in the liquid ejecting apparatus and a maintenance method for the liquid ejecting apparatus.

2. Related Art

In general, ink jet printers, which eject ink from nozzles of a liquid ejecting head onto a medium such as a paper sheet to perform printing, are widely known as one type of liquid ejecting apparatus. Among such printers are those equipped with a moisture retention cap device that moisturizes the interior of the nozzles by covering the nozzles of the liquid ejecting head with a cap portion so that ink in the nozzles does not thicken or solidify (refer to, for example, JP-A-2012-206516).

In a printer such as that described above, because the moisture retention cap device is disposed in a non-printing area where printing is not performed, which is next to a printing area where printing is performed, there is a problem that it is not possible to moisturize the inside of the nozzles and the periphery of the nozzles when the liquid ejecting head is positioned in the printing area.

The invention has been made focusing on such problems existing in the related art.

SUMMARY

An advantage of some aspects of the invention is that a liquid ejecting head unit and a liquid ejecting apparatus capable of moisturizing the inside of nozzles and the periphery of nozzles regardless of the position of the liquid ejecting head are provided.

Advantageous effects will be described below.

A liquid ejecting head unit according to an aspect of the invention includes a liquid ejecting head having a nozzle forming portion in which a nozzle that ejects a liquid to a medium is formed, a shutter that has an opening portion exposing the nozzle and that is movable between a cover position in which a recessed portion including the nozzle is covered and an exposure position in which the nozzle is exposed, and a first communication portion that communicates with an inside of the recessed portion and that is capable of supplying a fluid into the recessed portion.

According to this configuration, by supplying the maintenance liquid from the first communication portion into the recessed portion with the shutter moved to the cover position, the inside of the recessed portion can be humidified. Consequently, regardless of the position of the liquid ejecting head, it is possible to moisturize the inside of the nozzle and the periphery of the nozzle (inside the recessed portion).

It is preferable that the liquid ejecting head unit include a recessed portion forming member that is disposed between the nozzle forming portion and the shutter, that has a side wall surrounding the nozzle, and that forms the recessed portion together with a nozzle opening surface, at which the nozzle in the nozzle forming portion opens, and that the shutter move in a direction along the nozzle opening surface.

According to this configuration, a recessed portion can be easily formed.

In the liquid ejecting head unit, it is preferable that the recessed portion forming member be formed of a porous member.

According to this configuration, because the maintenance liquid can be held by the recessed portion forming member, the inside of the nozzle and the inside of the recessed portion can be effectively moisturized.

It is preferable that the liquid ejecting head unit include a second communication portion that communicates with the inside of the recessed portion and that is capable of recovering the fluid inside the recessed portion.

According to this configuration, fluid in the recessed portion can be recovered from the second communication portion.

A liquid ejecting apparatus according to another aspect of the invention includes a liquid ejecting head unit including a liquid ejecting head that ejects a liquid from a nozzle formed in a nozzle forming portion to a medium by driving an actuator and including a shutter that has an opening portion exposing the nozzle and that is movable between a cover position in which a recessed portion including the nozzle is covered and an exposure position in which the nozzle is exposed, and a maintenance liquid storage unit that is connected to a maintenance liquid supply port capable of supplying a maintenance liquid to the recessed portion and that stores the maintenance liquid. When the shutter is in the cover position, the maintenance liquid supply port and the maintenance liquid storage unit communicate with each other.

According to this configuration, because the inside of the recessed portion is humidified by the maintenance liquid of the maintenance liquid storage unit, it is possible to moisturize the inside of the nozzle and the periphery of the nozzle (inside the recessed portion) regardless of the position of the liquid ejecting head.

It is preferable that, when the shutter is in the cover position, the liquid ejecting apparatus supply the maintenance liquid from the maintenance liquid supply port into the recessed portion.

According to this configuration, because the inside of the recessed portion is humidified with the maintenance liquid, the inside of the nozzle and the inside of the recessed portion can be moisturized. Therefore, it is possible to suppress drying of the liquid attached to the inside of the recessed portion and to make it easy to recover the liquid.

It is preferable that, when the shutter is in the cover position, the liquid ejecting apparatus drive the actuator of the liquid ejecting head in a state where the maintenance liquid fills an inside of the recessed portion so as to be in contact with the nozzle.

According to this configuration, it is easy to discharge thickened liquid inside the nozzle.

It is preferable that, when the shutter is in the cover position, the liquid ejecting apparatus drive the actuator to eject the liquid from the nozzle toward an inner surface of the shutter.

According to this configuration, when the shutter is in the cover position, because flushing can be performed by ejecting liquid from the nozzle in order to eliminate thickening of the liquid inside the nozzle, maintenance of the liquid ejecting head by flushing can be performed even when, for example, the liquid ejecting head is at a position facing the medium.

It is preferable that the liquid ejecting apparatus include a recovery port capable of sucking fluid inside the recessed portion.

According to this configuration, for example, even when the liquid ejecting head is at a position facing the medium, it is possible to recover fluid used for maintenance of the periphery of the nozzle.

It is preferable that, when the shutter is in the cover position, the liquid ejecting apparatus suck and recover the fluid inside the recessed portion from the recovery port.

According to this configuration, because the inside of the recessed portion is sucked from the recovery port when the recessed portion is covered with the shutter, it is possible to efficiently recover fluid used for maintenance of the periphery of the nozzle.

It is preferable that, in the liquid ejecting apparatus, the recovery port and the inside of the recessed portion be at least partially in communication with each other via a communication path formed by the inner surface of the shutter, and when the shutter is in the exposure position, a suction operation be performed from the recovery port.

According to this configuration, when liquid is being ejected from the nozzle of the liquid ejecting head to the medium after flushing has been performed with the shutter moved to the cover position, it is possible to recover the liquid on the inner surface of the shutter while ejecting the liquid from the nozzle of the liquid ejecting head to the medium with the shutter moved to the exposure position. Consequently, it is possible to prevent interruption of the operation of ejecting the liquid from the nozzle of the liquid ejecting head to the medium by the recovery operation of recovering the liquid flushed on the inner surface of the shutter.

It is preferable that the liquid ejecting apparatus include a wiper that is disposed so as to be capable of coming into contact with at least the shutter, and, when the shutter is in the exposure position, the wiper and the shutter be moved relative to each other along an outer surface of the shutter with the wiper in contact with the shutter.

According to this configuration, at least liquid attached to the outer surface of the shutter can be wiped off by the wiper.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

Figure 3:
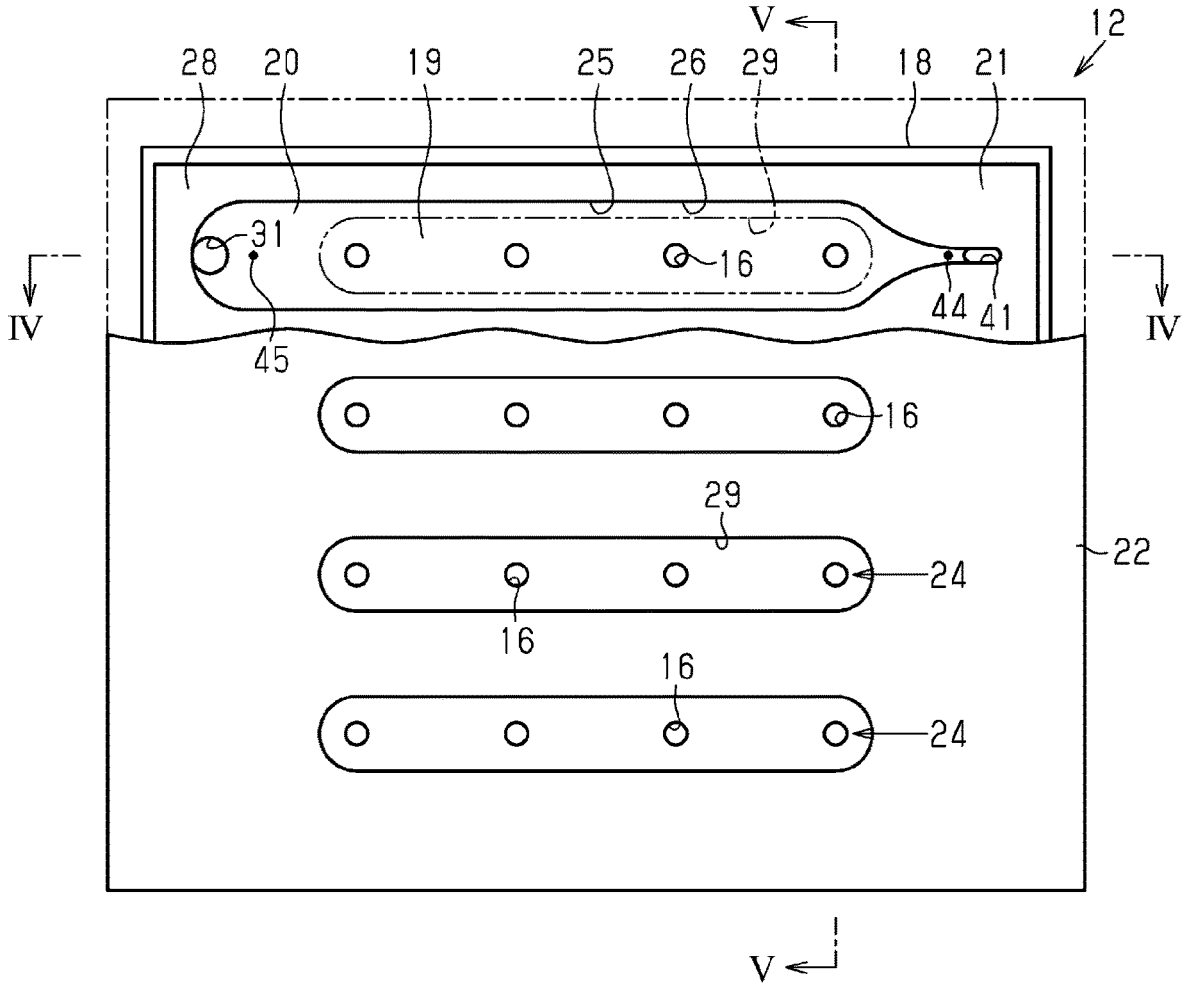
FIG. 3 is a schematic bottom view of a liquid ejecting head unit when a shutter is in an exposure position.

Further, in the drawings other than FIG. 3, the vertical direction of the page corresponds to the vertical direction (direction of gravity), and the lower side in the vertical direction is the lower side of the page.

Figure 1:
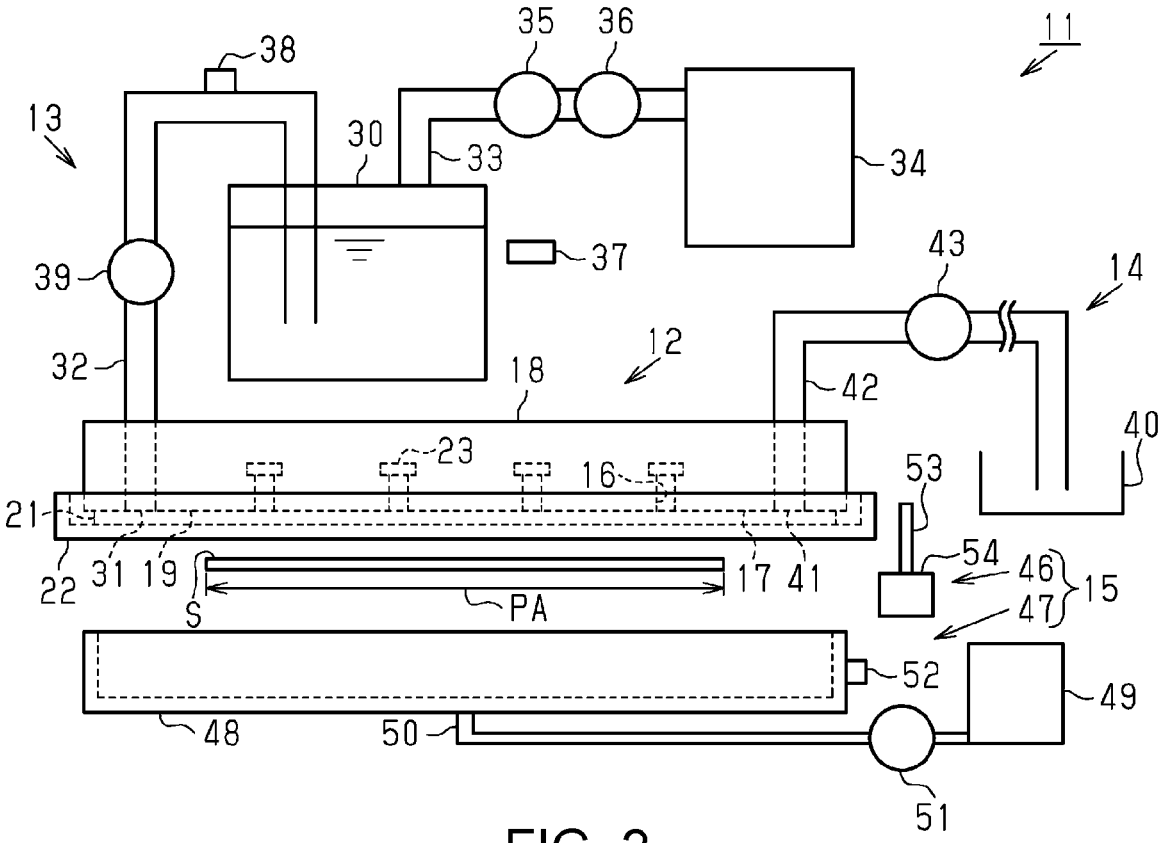
FIG. 1 is a schematic side view of a liquid ejecting apparatus according to an embodiment.

As illustrated in FIG. 1, a liquid ejecting apparatus 11 of this embodiment is constituted by an ink jet type printer that performs printing by ejecting ink as an example of a liquid onto a medium S such as a sheet of paper. The liquid ejecting apparatus 11 includes a liquid ejecting head unit 12 that ejects ink to the medium S, a fluid supply mechanism 13 capable of supplying a fluid such as a liquid or a gas different from ink to the liquid ejecting head unit 12, a recovery mechanism 14 that recovers a fluid from the liquid ejecting head unit 12, and a maintenance mechanism 15 that performs maintenance of the liquid ejecting head unit 12.

Figure 2:
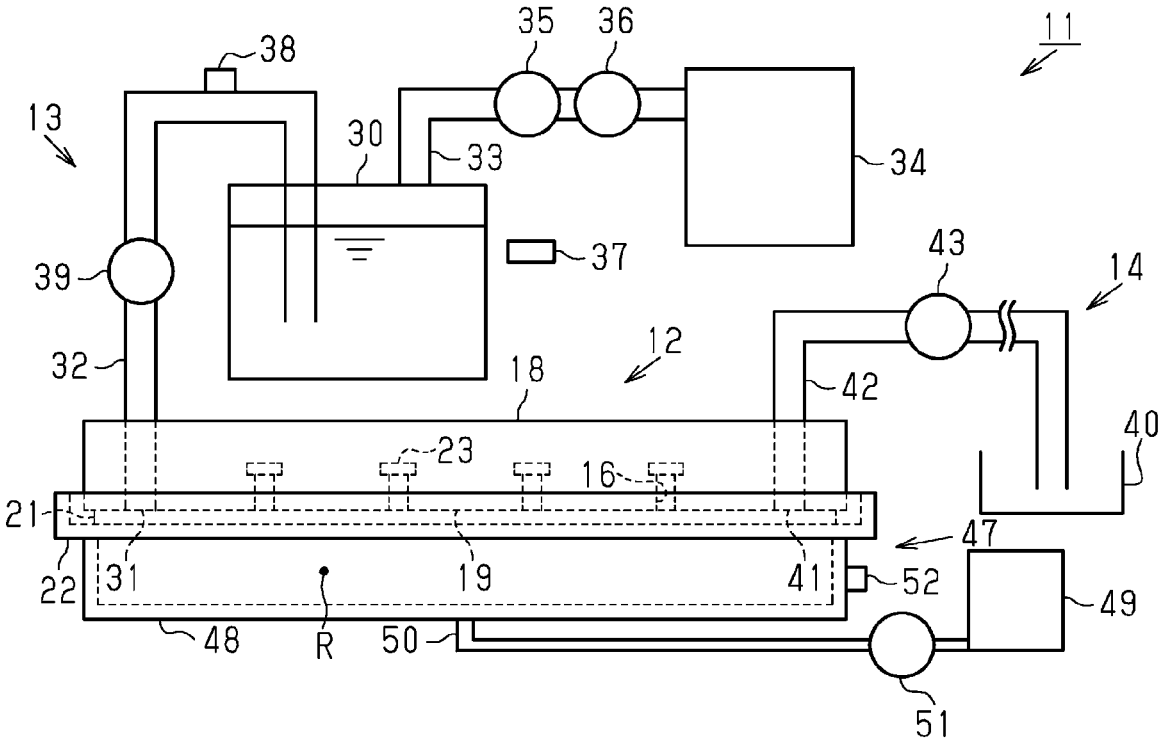
FIG. 2 is a schematic view illustrating a state when capping of a liquid ejecting head unit of a liquid ejecting apparatus in FIG. 1 is performed.

Further, in the liquid ejecting apparatus 11 of this embodiment, the liquid ejecting head unit 12 prints on the medium S disposed in the printing area PA that extends in the scanning direction which is a direction orthogonal to the paper surface in FIGS. 1 and 2 by ejecting ink while reciprocating in the scanning direction in a state where the liquid ejecting head unit 12 faces the printing area PA.

Figure 4:
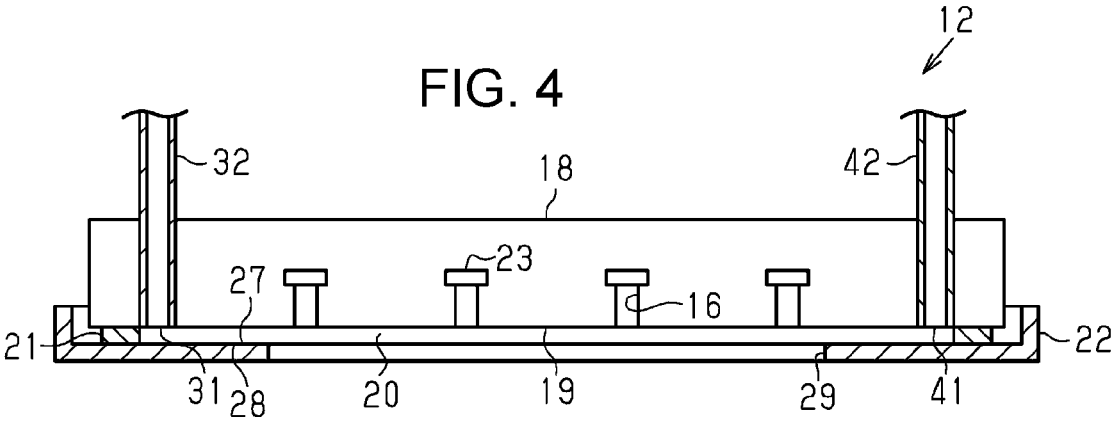
FIG. 4 is a cross-sectional view taken along the line IV-IV in FIG. 3.

As illustrated in FIGS. 1 and 4, the liquid ejecting head unit 12 includes a liquid ejecting head 18 having a nozzle forming portion 17 in which a plurality of nozzles 16 for ejecting ink to the medium S are formed, and a recessed portion forming member 21 that, together with a nozzle opening surface 19 at which the nozzles 16 of the nozzle forming portion 17 open, forms recessed portions 20 and a shutter 22 arranged so as to cover the recessed portion forming member 21. Therefore, the recessed portion forming member 21 is arranged between the nozzle forming portion 17 and the shutter 22.

The nozzle forming portion 17 in which the plurality of the nozzles 16 are formed is disposed at the end portion of the liquid ejecting head 18 on the printing area PA side. The nozzle forming portion 17 may be integrally formed with the liquid ejecting head 18 or may be formed separately from the liquid ejecting head 18. In the case where the nozzle forming portion 17 is formed separately from the liquid ejecting head 18, it is preferable that the recessed portion forming member 21 be configured to function as a fixing member that fixes the nozzle forming portion 17 to the liquid ejecting head 18.

Actuators 23 such as piezoelectric elements are each disposed in a corresponding one of the nozzles 16 formed in the nozzle forming portion 17 of the liquid ejecting head 18. The liquid ejecting head 18 ejects ink from each of the nozzles 16 to the medium S by driving a corresponding one of the actuators 23.

FIG. 3 illustrates, as an example, a state in which nozzle rows 24 are formed by disposing the plurality of the nozzles 16 side by side in a direction (a nozzle row direction which is a left and right direction in FIG. 3) that intersects the scanning direction (vertical direction in FIG. 3) on the nozzle opening surface 19 of the liquid ejecting head 18 that faces the printing area PA where the medium S is disposed.

In this case, a plurality of the nozzle rows 24 are formed by a plurality of the nozzles 16, and the plurality of the nozzle rows 24 are arranged in the scanning direction so as to be parallel to each other. The plurality of the nozzles 16 may, for each of the nozzle rows 24, for example, eject different kinds of liquids such as inks of different colors or may eject liquids of the same type such as inks of the same color.

As illustrated in FIGS. 3 and 4, the recessed portion forming member 21 has a rectangular plate shape and is liquid-tightly fixed to the nozzle opening surface 19 of the nozzle forming portion 17 with an adhesive or the like. The recessed portion forming member 21 has through holes 25 each of which extends along a corresponding one of the nozzle rows 24 at a position corresponding to the nozzle row 24.

The inner peripheral surface of each of the through holes 25 constitutes a side wall 26 surrounding a corresponding one of the nozzle rows 24 (the area of the nozzle opening surface 19, which includes the openings of the nozzles 16 forming the nozzle row 24, inside the through hole 25). That is, the recessed portion forming member 21 has the side walls 26 surrounding corresponding ones of the nozzle rows 24. The side walls 26 are also the side walls of corresponding ones of the recessed portions 20. Therefore, the area of the nozzle opening surface 19 inside each of the side walls 26 constitutes the bottom surface of the recessed portion 20.

The shutter 22 has a bottomed rectangular box shape having an opening, and an inner bottom surface 27 (inner surface) thereof is disposed so as to be slidable along an outer surface 28 of the recessed portion forming member 21. In this case, the gap between the inner bottom surface 27 of the shutter 22 and the outer surface 28 of the recessed portion forming member 21 is set to a value (for example, 10 micrometers or less) smaller than the diameter of the nozzles 16, and is sealed by the meniscus of the maintenance liquid.

Figure 5:
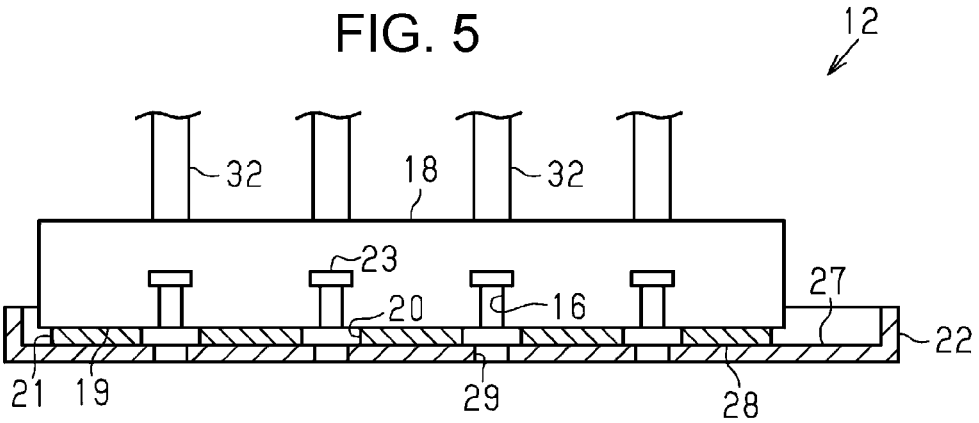
FIG. 5 is a cross-sectional view taken along the line V-V in FIG. 3.
Figure 6:
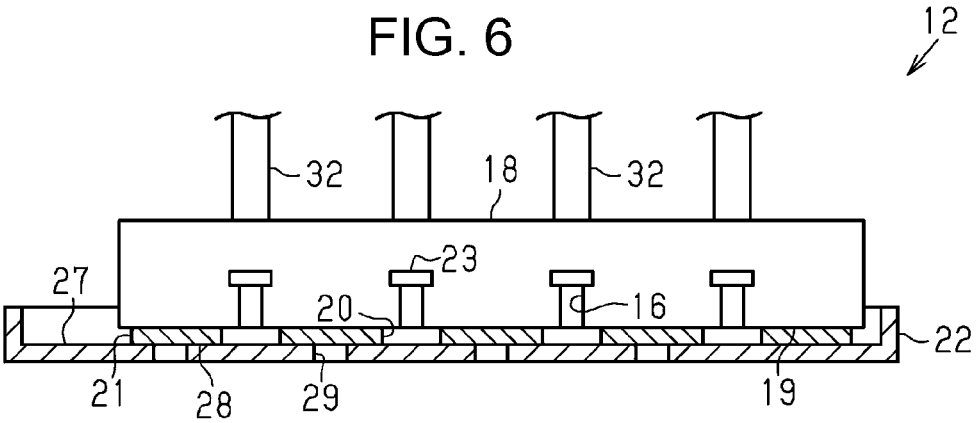
FIG. 6 is a view illustrating a state when the shutter has moved to the cover position in FIG. 5.

As illustrated in FIGS. 5 and 6, the shutter 22 is moved in a direction along the nozzle opening surface 19 by a mobile mechanism (not illustrated). In this embodiment, the shutter 22 is configured to be movable in a scanning direction (left and right direction in FIGS. 5 and 6) that intersects with the nozzle row direction. That is, the shutter 22 has opening portions 29 through which corresponding ones of the nozzle rows 24 are exposed, and is movable between a cover position (the position illustrated in FIG. 6) in which each of the recessed portions 20 including a corresponding one of the nozzle rows 24 is covered and an exposure position (position illustrated in FIG. 5) in which each of the recessed portions 20 including a corresponding one of the nozzle rows 24 is exposed.

Next, the configuration of the fluid supply mechanism 13 will be described in detail.

As illustrated in FIGS. 1 and 4, the fluid supply mechanism 13 includes a maintenance liquid storage unit 30 for storing a maintenance liquid, which is a liquid different from ink, and supply pipes 32 that connect the maintenance liquid storage unit 30 to maintenance liquid supply ports 31 capable of supplying the maintenance liquid to the recessed portions 20, respectively.

The maintenance liquid supply ports 31 open at the nozzle opening surface 19 of the liquid ejecting head 18 and communicate with the inside of the recessed portions 20, respectively. In this embodiment, a first communication portion capable of supplying a fluid (for example, a maintenance liquid, vapor of a maintenance liquid, or the like) into the recessed portions 20 is constituted by the maintenance liquid supply port 31.

Therefore, the first communication portion is included in the liquid ejecting head unit 12.

The end portion of the supply pipes 32 on the maintenance liquid storage unit 30 side is disposed inside the maintenance liquid stored in the maintenance liquid storage unit 30. It is preferable that the maintenance liquid stored in the maintenance liquid storage unit 30 be a liquid containing a solvent component of ink ejected from the liquid ejecting head 18. For example, in the case where the solvent component of ink is water, a liquid containing water (which may contain an additive such as a preservative) as a main component or water is stored in the maintenance liquid storage unit 30.

The fluid supply mechanism 13 further includes a liquid storage unit 34 that is connected to the maintenance liquid storage unit 30 via a connection pipe 33, a supply pump 35 that is provided in the connection pipe 33, a valve 36 that is disposed between the supply pump 35 in the connection pipe 33 and the liquid storage unit 34 and a detection unit 37 that detects the position of the liquid surface of the maintenance liquid inside the maintenance liquid storage unit 30.

In this case, when the detection unit 37 detects that the liquid surface position inside the maintenance liquid storage unit 30 is lower than a predetermined position, by driving the supply pump 35 with the valve 36 open, it is possible to replenish the maintenance liquid from the liquid storage unit 34, which stores the maintenance liquid, to the maintenance liquid storage unit 30.

Further, in the liquid ejecting apparatus 11, a configuration may be adopted in which the fluid supply mechanism 13 does not include the liquid storage unit 34, the connection pipe 33, the supply pump 35, the valve 36, and the detection unit 37, and the maintenance liquid is directly replenished into the maintenance liquid storage unit 30 or the maintenance liquid is replenished by replacing the maintenance liquid storage unit 30 which is in a cartridge form.

The supply pipes 32 are provided with an atmospheric release valve 38 for opening the inside of the supply pipes 32 to the atmosphere and an opening and closing valve 39 for opening and closing a flow path inside the supply pipes 32. The opening and closing valve 39 is disposed at a position closer to the liquid ejecting head 18 than the atmospheric release valve 38 in the supply pipes 32. Then, when the shutter 22 is in the cover position and when the atmospheric release valve 38 is closed and the opening and closing valve 39 is opened, the maintenance liquid supply ports 31 and the maintenance liquid storage unit 30 communicate with each other.

Then, a humidified gas such as air containing the vapor of the maintenance liquid inside the maintenance liquid storage unit 30 is supplied into the recessed portions 20 from the maintenance liquid supply ports 31 via the supply pipes 32, and the inside of the recessed portions 20 is consequently humidified. On the other hand, when the atmospheric release valve 38 is opened, humidified gas such as air containing vapor of the maintenance liquid inside the maintenance liquid storage unit 30 is released from the atmospheric release valve 38 into the atmosphere. Therefore, even if the opening and closing valve 39 is not closed, almost no humidified gas is supplied into the recessed portions 20.

Next, the configuration of the recovery mechanism 14 will be described in detail.

As illustrated in FIGS. 1 and 4, the recovery mechanism 14 includes a waste liquid tank 40, recovery pipes 42 that connect recovery ports 41, through which the fluid in the recessed portions 20 can be sucked, and the waste liquid tank 40 respectively to each other, and a recovery pump 43 provided in the recovery pipes 42. By driving the recovery pump 43, the recovery pump 43 sucks the fluid inside the recovery pipes 42 from the recessed portions 20 toward the waste liquid tank 40.

The recovery ports 41 open at the nozzle opening surface 19 of the liquid ejecting head 18 and communicate with the inside of the recessed portions 20, respectively. In this embodiment, a second communication portion capable of recovering the fluid (maintenance liquid, ink, air, or the like) inside the recessed portions 20 is constituted by the recovery port 41. Therefore, the second communication portion is provided in the liquid ejecting head unit 12.

As illustrated in FIGS. 3 and 4, the recovery ports 41 are positioned on the side of the nozzle rows 24 opposite to the maintenance liquid supply port 31. In other words, the recovery ports 41 open at an end portion (right end portion in FIG. 3) of the recessed portions 20 in the nozzle row direction (right and left direction in FIG. 3) and the maintenance liquid supply ports 31 open at the other end portion (left end portion in FIG. 3) of the recessed portions 20 in the nozzle row direction.

The recovery ports 41 and the inside of the recessed portions 20 (the area surrounded by a two-dot chain line in FIG. 3 in the embodiment) respectively communicate with each other via first communication paths 44 formed by the inner bottom surface 27 of the shutter 22. The maintenance liquid supply ports 31 and the inside of the recessed portions 20 (the area surrounded by the two-dot chain line in FIG. 3 in the embodiment) respectively communicate with each other via second communication paths 45 formed by the inner bottom surface 27 of the shutter 22. The width of the first communication paths 44 in the scanning direction (vertical direction in FIG. 3) is narrower than the width of the second communication paths 45 in the scanning direction. Therefore, the capillary force of the second communication paths 45 is smaller than the capillary force of the first communication paths 44.

That is, the first communication paths 44 are formed in a narrow groove shape so that unnecessary maintenance liquid and ink remaining inside the recessed portions 20 can be easily drawn into the recovery ports 41. On the other hand, the second communication paths 45 are formed in a shape in which the width in the scanning direction is markedly wider than that of the first communication paths 44. That is, by ensuring a large space around the maintenance liquid supply ports 31 inside the recessed portions 20, it is easy to supply the maintenance liquid from the maintenance liquid supply ports 31 into the recessed portions 20, respectively. Further, in order to effectively humidify the inside of the recessed portions 20, an absorbent material that absorbs and holds the maintenance liquid may be disposed in the second communication passages 45 as necessary.

Next, the configuration of the maintenance mechanism 15 will be described in detail.

As illustrated in FIGS. 1 and 2, the maintenance mechanism 15 includes a wiping mechanism 46 that is disposed in a non-printing area located at a position deviated from the printing area PA in the scanning direction and that wipes the liquid ejecting head unit 12, and a capping mechanism 47 that suppresses clogging of the nozzles 16.

The capping mechanism 47 includes a cap portion 48, which is relatively movable with respect to the liquid ejecting head unit 12, a waste liquid storage unit 49, a waste liquid flow path 50 that connects the cap portion 48 and the waste liquid storage unit 49 to each other, a pressure reducing mechanism 51 provided in the waste liquid flow path 50, and an atmospheric release valve 52 attached to the cap portion 48. The pressure reducing mechanism 51 is constituted by, for example, a tube pump.

As illustrated in FIG. 2, the cap portion 48 having a bottomed box shape with an opening moves in a direction approaching the liquid ejecting head unit 12, and performs capping so as to form the closed space R by covering the nozzle opening surface 19 through the recessed portion forming member 21 and the shutter 22. The cap portion 48 is not limited to a bottomed box shape with an opening as illustrated in FIG. 2; for example, an annular elastic member surrounding an area to which each of the nozzles 16 opens may be disposed on the liquid ejecting head unit 12 side and a flat plate member which forms the closed space R by making contact with this elastic member may be used as the cap portion 48.

When the liquid ejecting head unit 12 is capped by the cap portion 48, the closed space R is opened to the atmosphere when the atmospheric release valve 52 is opened, whereas when the atmospheric release valve 52 is closed, the closed space R is substantially sealed. Therefore, after the liquid ejecting head unit 12 is capped with the shutter 22 in the exposure position, when the atmospheric release valve 52 and the opening and closing valve 39 are closed and the pressure reducing mechanism 51 is driven, the closed space R is depressurized and a negative pressure is generated and suction cleaning is performed such that bubbles and the like mixed inside the liquid ejecting head 18 are discharged together with the ink through each of the nozzles 16. The ink (waste liquid) discharged from each of the nozzles 16 into the cap portion 48 by suction cleaning is recovered in the waste liquid storage unit 49 through the waste liquid flow path 50.

As illustrated in FIG. 1, the wiping mechanism 46 includes a wiper 53 disposed so as to be capable of coming into contact with at least the shutter 22, and a mobile body 54 that moves while holding the wiper 53. By the wiper 53, for example, after execution of suction cleaning, moving along the outer surface of the shutter 22 in the exposure position while in contact with the shutter 22 in accordance with the movement of the mobile body 54, wiping is performed to wipe off ink and the like attached to the outer surface of the shutter 22 and the inside of the recessed portions 20 including the nozzle opening surface 19.

Further, the wiping by the wiper 53 may be performed by moving the liquid ejecting head unit 12 in a state where the wiper 53 is stopped or by moving both the wiper 53 and the liquid ejecting head unit 12. That is, wiping by the wiper 53 may be performed by moving the wiper 53 and the liquid ejecting head unit 12 relative to each other.

Next, the operation of the liquid ejecting apparatus 11 will be described.

During printing of the medium S, while the liquid ejecting head unit 12 with the shutter 22 in the exposure position is reciprocating in the scanning direction while facing the printing area PA, ink is ejected from each of the nozzles 16 to the medium S disposed in the printing area PA. At this time, when the atmospheric release valve 38 is closed while the shutter 22 is moved from the exposure position to the cover position and the opening and closing valve 39 is open, the maintenance liquid supply port 31 and the maintenance liquid storage unit 30 communicate with each other.

Then, a humidified gas such as air containing the vapor of the maintenance liquid inside the maintenance liquid storage unit 30 is supplied into the recessed portions 20 from the maintenance liquid supply ports 31 via the supply pipes 32 and the inside of the recessed portions 20 is consequently humidified. Consequently, the inside of each of the nozzles 16 and the periphery of each of the nozzles 16 are moisturized, and drying of ink inside each of the nozzles 16 and ink attached to the inside of the recessed portions 20 is suppressed.

Furthermore, at this time, when the recovery pump 43 is driven, the inside of the recessed portions 20 is sucked by the recovery pump 43 and depressurized. Consequently, a negative pressure is generated in the recessed portions 20, and the maintenance liquid inside the maintenance liquid storage unit 30 is supplied from the maintenance liquid supply ports 31 into the recessed portions 20 via the supply pipes 32 by this negative pressure. Consequently, the inside of each of the nozzles 16 and the periphery of each of the nozzles 16 are effectively moisturized. In this case, it is preferable that the negative pressure generated inside the recessed portions 20 be a negative pressure lower than the meniscus resistance pressure of the meniscus seal between the shutter 22 and the recessed portion forming member 21.

Further, in the case where the maintenance liquid inside the maintenance liquid storage unit 30 is supplied from the maintenance liquid supply ports 31 into the recessed portions 20, after opening the recovery ports 41 to the atmosphere, by driving the supply pump 35 to pressurize the inside of the maintenance liquid storage unit 30 and by separately driving a feed pump provided on the supply pipes 32, the maintenance liquid may be pressurized and supplied into the recessed portions 20 at a positive pressure lower than the meniscus resistance pressure of the meniscus seal between the shutter 22 and the recessed portion forming member 21.

In this way, in the liquid ejecting apparatus 11 of this embodiment, it is possible to moisturize the inside of the nozzles 16 and the periphery of the nozzles 16 without using the maintenance mechanism 15. That is, in the liquid ejecting apparatus 11 of this embodiment, the inside of the nozzles 16 and the periphery of the nozzles 16 can be moisturized irrespective of the position of the liquid ejecting head unit 12 (the liquid ejecting head 18). In other words, as described above, in the liquid ejecting apparatus 11 of this embodiment, even in the case where the liquid ejecting head unit 12 is at a position facing the printing area PA, the inside of the nozzles 16 and the periphery of the nozzles 16 can be moisturized.

In addition, irrespective of printing performed from each of the nozzles 16 of the liquid ejecting head unit 12, flushing for ejecting ink for the purpose of eliminating thickening of ink in each of the nozzles 16 is performed at a position where the liquid ejecting head unit 12 faces the medium S (printing area PA) during printing. This flushing is carried out by driving each of the actuators 23 with the shutter 22 moved to the cover position and ejecting ink from each of the nozzles 16 toward the inner bottom surface 27 of the shutter 22.

Thereafter, when the recovery pump 43 is driven with the shutter 22 moved to the exposure position, because the opening portions 29 of the shutter 22 are narrower than the through holes 25 of the recessed portion forming member 21 in the movement direction of the shutter 22, the flushing ink attached to the inner bottom surface 27 of the shutter 22 is sucked from the recovery ports 41 and recovered in the waste liquid tank 40. At this time, because the shutter 22 is in the exposure position, it is possible to perform ejection of ink to the medium S from each of the nozzles 16. That is, the suction operation of sucking the flushing ink from the recovery ports 41 driven by the recovery pump 43 is performed without interrupting printing of the medium S.

In addition, regardless of the position of the liquid ejecting head unit 12, when the atmospheric release valve 38 and the opening and closing valve 39 are opened at an appropriate timing and the recovery pump 43 is driven with the shutter 22 in the cover position, ink attached to the inside of the recessed portions 20 (the periphery of the nozzles 16 and the like) and the maintenance liquid are sucked from the recovery ports 41 together with air and recovered in the waste liquid tank 40. In this case, in the case where the opening and closing valve 39 is closed, it is preferable that the inside of the recessed portions 20 be sucked by the recovery pump 43 so that the negative pressure generated in the recessed portions 20 becomes a negative pressure higher than the meniscus resistance pressure of the meniscus seal between the shutter 22 and the recessed portion forming member 21.

According to the embodiment described above, the following effects can be obtained.

(1) The liquid ejecting head unit 12 includes the maintenance liquid supply ports 31 that communicate with the inside of the recessed portions 20 and that are capable of supplying a fluid into the recessed portions 20. Consequently, by supplying the maintenance liquid from the maintenance liquid supply ports 31 into the recessed portions 20 with the shutter 22 moved to the cover position, the inside of the recessed portions 20 can be humidified. Therefore, the inside of the nozzles 16 and the periphery of the nozzles 16 (inside the recessed portions 20) can be moisturized regardless of the position of the liquid ejecting head 18.

(2) The liquid ejecting head unit 12 includes the recessed portion forming member 21 that forms the recessed portions 20 together with the nozzle opening surface 19. Consequently, the recessed portions 20 can be easily formed.

(3) The liquid ejecting head unit 12 includes the recovery ports 41 that communicate with the inside of the recessed portions 20 and that are capable of recovering the fluid inside the recessed portions 20. Consequently, unnecessary fluid such as unnecessary ink and maintenance liquid inside the recessed portions 20 can be recovered from the recovery ports 41.

(4) When the shutter 22 is in the cover position, the liquid ejecting apparatus 11 causes the maintenance liquid supply ports 31 and the maintenance liquid storage unit 30 to communicate with each other. Therefore, because the inside of the recessed portions 20 is humidified by the maintenance liquid of the maintenance liquid storage unit 30, it is possible to moisturize the inside of the nozzles 16 and the periphery of the nozzles 16 (inside the recessed portions 20) regardless of the position of the liquid ejecting head 18 (the liquid ejecting head unit 12).

(5) When the shutter 22 is in the cover position, the liquid ejecting apparatus 11 supplies the maintenance liquid from the maintenance liquid supply ports 31 into the recessed portions 20. Consequently, because the inside of the recessed portions 20 is humidified with the maintenance liquid, it is possible to moisturize the inside of the nozzles 16 and the inside of the recessed portions 20. Therefore, it is possible to suppress the drying of ink attached to the inside of the recessed portions 20 and to make it easy to recover the ink from the recovery ports 41.

(6) When the shutter 22 is in the cover position, the liquid ejecting apparatus 11 drives the actuators 23 and ejects ink from the nozzles 16 toward the inner bottom surface 27 of the shutter 22. Therefore, when the shutter 22 is in the cover position, it is possible to perform flushing in order to eliminate thickening of ink inside the nozzles 16 by ejecting ink from the nozzles 16. Therefore, maintenance of the liquid ejecting head 18 by flushing can be performed even in a state in which the liquid ejecting head 18 is at a position facing the medium S (printing area PA).

(7) The liquid ejecting apparatus 11 includes recovery ports capable of sucking the fluid inside the recessed portions 20. Therefore, even when the liquid ejecting head 18 is at a position facing the medium S, it is possible to recover a fluid such as a maintenance liquid used for maintenance in the periphery of the nozzles 16.

(8) When the shutter 22 is in the cover position, the liquid ejecting apparatus 11 sucks and recovers the fluid inside the recessed portions 20 from the recovery ports 41. Therefore, because the inside of the recessed portions 20 is sucked from the recovery ports 41 with the recessed portions 20 covered by the shutter 22, it is possible to efficiently recover fluid such as the maintenance liquid used for maintenance in the periphery of the nozzles 16.

(9) In the liquid ejecting apparatus 11, the recovery ports 41 and the inside of the recessed portions 20 are at least partially in communication with each other via communication paths formed by the inner bottom surface 27 of the shutter 22, and when the shutter 22 is in the exposure position, the suction operation of sucking from the recovery ports 41 is performed. Consequently, during printing, after flushing has been performed with the shutter 22 moved to the cover position, while ejecting ink from the nozzles 16 of the liquid ejecting head 18 onto the medium S with the shutter 22 moved to the exposure position, the flushing ink attached to the inner bottom surface 27 of the shutter 22 can be recovered. Therefore, as a result of the recovery operation of recovering the flushing ink attached to the inner bottom surface 27 of the shutter 22, it is possible to prevent the printing operation of the liquid ejecting head from being interrupted.

(10) The liquid ejecting apparatus 11 includes the wiper 53 disposed so as to be in contact with at least the shutter 22 and when the shutter 22 is in the exposure position and the wiper 53 is in contact with the shutter 22, the wiper 53 and the shutter 22 move relative to each other along the outer surface of the shutter 22. Consequently, at least the ink attached to the outer surface of the shutter 22 can be wiped by the wiper 53.

Modification Examples

Further, the above embodiment may be modified as follows.

The wiper 53 may be omitted.

The recovery ports 41 may be omitted.

The opening and closing valve 39 may be omitted.

The shutter 22 may be formed in a flat plate shape.

The recessed portion forming member 21 may be omitted. In this case, the recessed portions 20 are formed, for example, by making the nozzle opening surface 19 of the nozzle forming portion 17 uneven. In this way, the number of components constituting the liquid ejecting head unit 12 can be reduced. In this case, by forming the nozzle forming portion 17 and the shutter 22 of a magnetic material (for example, SUS 430 or electromagnetic stainless steel), the shutter 22 may slidably adsorb to the nozzle opening surface 19 of the nozzle forming portion 17 by magnetic force. In the case where separate magnets are not provided in the liquid ejecting head unit 12, at least one of the nozzle forming portion 17 and the shutter 22 may be magnetized.

The recessed portion forming member 21 may be constituted by a porous member. In this case, because the maintenance liquid can be held by the recessed portion forming member 21, the inside of the nozzles 16 and the inside of the recessed portions 20 can be effectively moisturized.

The recessed portion forming member 21 may be formed of rubber, elastomer (silicon type, fluorine type or the like), plastic film (polyethylene, polypropylene, polyamide, polyethylene terephthalate or the like), or the like. In this way, it is possible to improve sealing properties between the recessed portion forming member 21 and both the nozzle opening surface 19 and the shutter 22.

Figure 7:
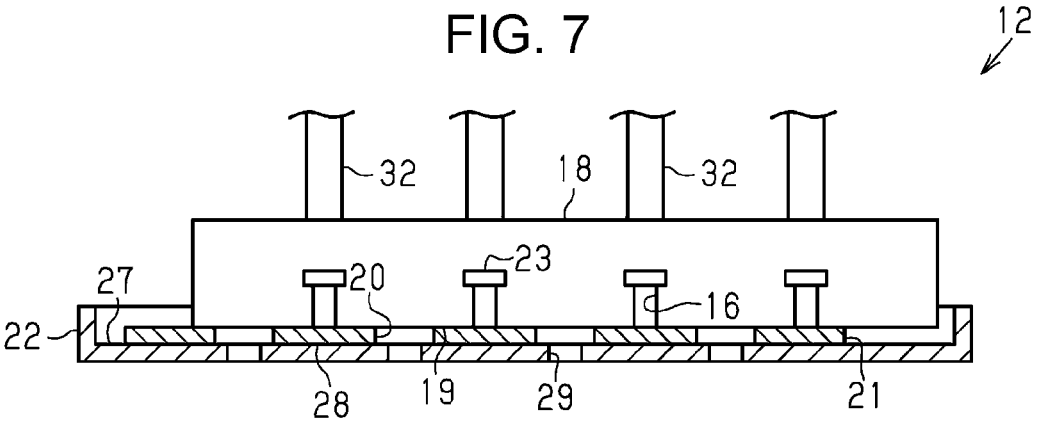
FIG. 7 is a schematic cross-sectional view illustrating an operation of a liquid ejecting head unit of a modification example.
Figure 8:
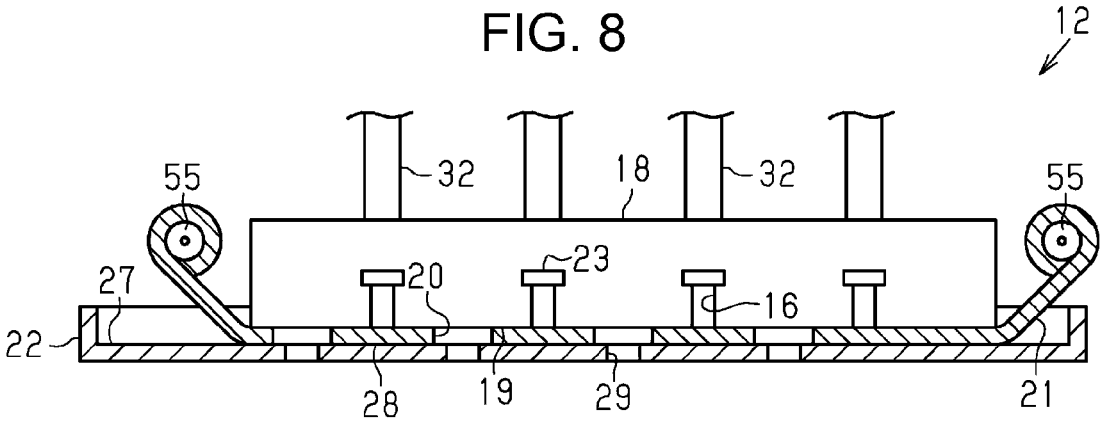
FIG. 8 is a schematic cross-sectional view of a liquid ejecting head unit of a modification example.

In the liquid ejecting apparatus 11, the recessed portion forming member 21 can slide along the nozzle opening surface 19 in the scanning direction in the same way as the shutter 22, and the shutter 22 and the recessed portion forming member 21 may be individually slid. In this case, the recessed portion forming member 21 moves between the open position (the position illustrated in FIG. 6) in which the nozzles 16 are open and the closed position (the position illustrated in FIG. 7) in which the nozzles 16 are closed. In this way, after the maintenance operation with the shutter 22 moved to the cover position, it is possible to wipe the nozzle opening surface 19 by using the recessed portion forming member 21 by sliding only the recessed portion forming member 21 from the open position to the closed position. Thereafter, moisturizing of the inside of the nozzles 16 and the recessed portions 20 is performed by returning the recessed portion forming member 21 to the open position and waiting, and in the case where printing is to be performed, the shutter 22 in the cover position is moved to the exposure position. Further, as a mechanism that slides the recessed portion forming member 21 along the nozzle opening surface 19 in the scanning direction, as illustrated in FIG. 8, a pair of winding shafts 55 disposed so as to face the liquid ejecting head 18 in the scanning direction may be used. In this case, the recessed portion forming member 21 is formed of a flexible material, and the two ends thereof in the scanning direction are respectively attached to the pair of the winding shafts 55. Then, by winding the recessed portion forming member 21 with one of the winding shafts 55 and winding the recessed portion forming member 21 with the other one of the winding shafts 55, the recessed portion forming member 21 slides between the open position and the closed position. In this case, the nozzle opening surface 19 may be wiped by the recessed portion forming member 21 by winding the recessed portion forming member 21 with only one of the pair of winding shafts 55. In the case of the recessed portion forming member 21 being completely wound by one of the winding shafts 55, the old recessed portion forming member 21 may be replaced with a new recessed portion forming member 21.

When the shutter 22 is in the cover position, the liquid ejecting apparatus 11 may drive the actuators 23 of the liquid ejecting head 18 in a state where the maintenance liquid fills the inside of the recessed portions 20 so as to be in contact with the nozzles 16. In this way, it is possible to make it easier to discharge thickened ink inside the nozzles 16.

By forming the recessed portion forming member 21 and the shutter 22 of a magnetic material (for example, SUS 430, electromagnetic stainless steel or the like), the shutter 22 may be slidably adsorbed to the recessed portion forming member 21 by magnetic force. In the case where no separate magnets are provided in the liquid ejecting head unit 12, at least one of the recessed portion forming member 21 and the shutter 22 may be magnetized.

The wiper 53 may be formed of an absorbent member such as a cloth wiper and the outer surface of the shutter 22 may be wiped by the absorbent member with the shutter 22 moved to the cover position. In this way, because the absorbent member comes into contact with the outer surface of the recessed portion forming member 21 via the opening portions 29 of the shutter 22, the ink, the maintenance liquid, or the like remaining between the inner bottom surface 27 of the shutter 22 and the outer surface of the recessed portion forming member 21 can be absorbed by the absorbent member and recovered.

Figure 9:
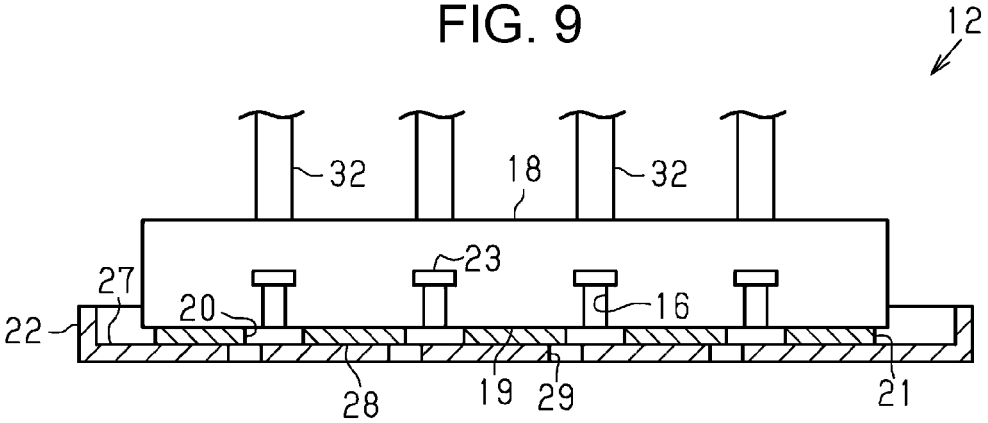
FIG. 9 is a schematic cross-sectional view illustrating an operation of a liquid ejecting head unit of a modification example.

In the case where flushing of the inner bottom surface 27 of the shutter 22 is performed, it is not absolutely necessary to move the shutter 22 to the cover position. For example, as illustrated in FIG. 9, flushing may be performed on the inner bottom surface 27 of the shutter 22 with the shutter 22 moved so that the recessed portions 20 are about half-covered.

The liquid ejecting apparatus 11 may perform suction cleaning in which ink (liquid) is sucked from the nozzles 16 by generating negative pressure inside the recessed portions 20 by moving the shutter 22 to the cover position and driving the recovery pump 43 with the opening and closing valve 39 closed.

The liquid ejecting apparatus 11 may, without performing maintenance of the liquid ejecting head 18 using the shutter 22, perform maintenance of the liquid ejecting head 18 using the maintenance mechanism 15. That is, maintenance of the liquid ejecting head 18 such as suction cleaning, pressure cleaning, wiping, and flushing is performed with the shutter 22 of the liquid ejecting head unit 12 moved to the exposure position in a state where the liquid ejecting head unit 12 is waiting at a position facing the non-printing area.

The liquid ejecting apparatus 11 may perform maintenance (for example, suction cleaning, flushing, or the like) of the liquid ejecting head 18 using the shutter 22 in a state where the liquid ejecting head unit 12 is waiting at a position facing the non-printing area.

The liquid ejecting apparatus 11 may be a printer having only a printing function, or may be a facsimile, a copying apparatus, or a printer included in a multifunction machine including these apparatuses.

The liquid ejecting apparatus 11 may be a so-called line head type printer in which the liquid ejecting head unit 12 does not move (scan).

The liquid ejecting apparatus 11 may be a liquid ejecting apparatus that ejects or discharges liquid other than ink. The liquid discharged as a minute amount of liquid droplets from the liquid ejecting apparatus may have a granular shape, teardrop shape, or thread-like tail shape. The liquid may be any material that can be ejected from the liquid ejecting apparatus. For example, the liquid may be any substance which is in a liquid phase, and may be a liquid body having high or low viscosity or a fluid body such as sol, gel water, another inorganic solvent, organic solvent, solution, liquid resin, or liquid metal (metal melt). The liquid may be not only a liquid as one state of a substance but alternatively a liquid obtained by dissolving, dispersing or mixing particles of a functional material composed of a solid such as a pigment or metal particles in a solvent. Representative examples of the liquid include ink, liquid crystal, and the like as described in the above embodiment. The ink may be any of various kinds of liquid compositions such as general water-based ink, oil-based ink, gel ink, hot melt ink or the like. Specific examples of the liquid ejecting apparatus include liquid ejecting apparatuses that eject liquids containing dispersed or dissolved materials such as electrode materials or coloring materials used for manufacturing liquid crystal displays, EL (electroluminescence) displays, surface emitting displays, color filters, or the like. The liquid ejecting apparatus may be a liquid ejecting apparatus that ejects a bioorganic material used for biochip manufacturing, a liquid ejecting apparatus that is used as a precision pipette and that ejects a liquid serving as a sample, a textile printing apparatus, a micro-dispenser, or the like. The liquid ejecting apparatus may be a liquid ejecting apparatus that ejects lubricating oil onto a precision machine such as a watch or a camera in a pinpoint manner, or a liquid ejecting apparatus that ejects a transparent resin liquid such as an ultraviolet curable resin onto a substrate to form a micro-hemispherical lens (optical lens) or the like used for an optical communication element or the like. The liquid ejecting apparatus may be a liquid ejecting apparatus that ejects an etching solution such as an acid or an alkali to etch a substrate or the like.

In the embodiment, by making the openings of the maintenance liquid supply ports 31 at the nozzle opening surface 19 open in an area of the nozzle opening surface 19 inside the recessed portions 20, the openings of the maintenance liquid supply ports 31 at the nozzle opening surface 19 communicate with the inside of the recessed portions 20; however, in the case where the openings of the maintenance liquid supply ports 31 at the nozzle opening surface 19 and the inside of the recessed portions 20 are made to communicate using the gap between the inner bottom surface 27 of the shutter 22 and the outer surface 28 of the recessed portion forming member 21, the openings of the maintenance liquid supply ports 31 at the nozzle opening surface 19 do not have to open in an area of the nozzle opening surface 19 inside the recessed portions 20.

In the embodiment, by making the openings of the recovery ports 41 at the nozzle opening surface 19 open in the area of the nozzle opening surface 19 inside the recessed portions 20, the inside of the recessed portions 20 communicates with the openings of the recovery ports 41 at the nozzle opening surface 19; however, in the case where the openings of the recovery ports 41 at the nozzle opening surface 19 and the inside of the recessed portions 20 are made to communicate using the gap between the inner bottom surface 27 of the shutter 22 and the outer surface 28 of the recessed portion forming member 21, the openings of the recovery ports 41 at the nozzle opening surface 19 do not have to open in an area of the nozzle opening surface 19 inside the recessed portions 20.

In the embodiment, the inside of the recessed portions 20 and the openings of the maintenance liquid supply ports 31 at the nozzle opening surface 19 are made to communicate with each other through the second communication paths 45 (the portion of the recessed portions 20 serving as the second guide path), however, grooves may be provided in the inner bottom surface 27 of the shutter 22 and consequently the second communication paths 45 (the second guide path) that enable the openings of the maintenance liquid supply ports 31 at the nozzle opening surface 19 and the inside of the recessed portions 20 to communicate with each other may be formed. In this case, the openings of the maintenance liquid supply ports 31 at the nozzle opening surface 19 need not open in an area of the nozzle opening surface 19 inside the recessed portions 20.

In the embodiment, the openings of the recovery ports 41 at the nozzle opening surface 19 and the inside of the recessed portions 20 are made to communicate with each other through the first communication paths 44 (the portion of the recessed portions 20 serving as the first guide path); however, narrow grooves may be provided in the inner bottom surface 27 of the shutter 22 and consequently the first communication paths 44 (a first guide path) that enable the inside of the recessed portions 20 to communicate with the openings of the recovery ports 41 at the nozzle opening surface 19 may be formed. In this case, the openings of the recovery ports 41 at the nozzle opening surface 19 need not open in an area of the nozzle opening surface 19 inside the recessed portions 20.

What is claimed is:

1. A liquid ejecting head unit comprising:

a liquid ejecting head having a nozzle forming portion in which a nozzle that ejects a liquid to a medium is formed;

a recessed portion forming portion that is positioned on a side of a nozzle opening surface where the nozzle in the nozzle forming portion opens and that has a side wall surrounding the nozzle and forms a recessed portion together with the nozzle opening surface;

a shutter that has an opening portion exposing the nozzle and that is movable between a cover position in which the recessed portion including the nozzle is covered and an exposure position in which the nozzle is exposed; and a first communication portion that communicates with an inside of the recessed portion and that is capable of supplying a fluid into the recessed portion.

2. The liquid ejecting head unit according to claim 1 wherein the recessed portion forming portion is formed by a recessed portion forming member that is disposed between the nozzle forming portion and the shutter, and the shutter moves in a direction along the nozzle opening surface.

3. The liquid ejecting head unit according to claim 2, wherein the recessed portion forming member is formed of a porous member.

4. The liquid ejecting head unit according to claim 1, further comprising:

a second communication portion that communicates with the inside of the recessed portion and that is capable of recovering the fluid inside the recessed portion.

* * * * *